US005275496A

United States Patent [19]

Fattori et al.

[11] Patent Number: 5,275,496

[45] Date of Patent: Jan. 4, 1994

[54] STICK PACKAGE WITH APPLICATOR SURFACE

[75] Inventors: Joseph E. Fattori, Mendham; Robert Suffis, Morristown, both of N.J.

[73] Assignee: The Mennen Company, Morristown, N.J.

[21] Appl. No.: 489,732

[22] Filed: Feb. 28, 1990

Related U.S. Application Data

[63] Continuation of Ser. No. 153,439, Feb. 8, 1988, abandoned.

[51] Int. Cl.[5] ..... A45D 40/06; A45D 40/00

[52] U.S. Cl. ..... 401/68; 401/75; 401/175; 401/266

[58] Field of Search ..... 401/176, 68, 75, 79, 401/261, 265, 266, 175, 78, ; 132/318, 319, 320

[56] References Cited

U.S. PATENT DOCUMENTS

| | | | |
|---|---|---|---|
| 1,017,957 | 2/1912 | Clark | 401/266 X |
| 1,590,069 | 6/1926 | Bacon et al. | 132/318 X |
| 1,781,852 | 11/1930 | Lyhne | 401/78 |
| 1,836,800 | 12/1931 | Hope | 401/261 X |
| 1,953,296 | 4/1934 | Gleeson | 132/318 X |
| 1,968,686 | 7/1934 | Janer | 401/266 X |
| 1,988,088 | 1/1935 | Philippe | 401/265 X |
| 2,034,137 | 3/1936 | Fitz-Gibbon | 401/266 |
| 2,336,328 | 12/1943 | Whalen | 401/79 X |
| 2,336,357 | 12/1943 | Hixson | 401/266 X |
| 2,374,065 | 4/1945 | Worthington | 132/320 X |
| 2,379,105 | 6/1945 | Rosa | 401/266 X |
| 2,448,033 | 8/1948 | Kruck | 401/266 X |
| 3,226,762 | 1/1966 | Norman | 401/266 X |
| 3,912,403 | 10/1975 | Gjerloff | 401/176 |
| 4,708,267 | 11/1987 | Sieverding et al. | 401/265 X |

FOREIGN PATENT DOCUMENTS

| | | | |
|---|---|---|---|
| 557384 | 5/1957 | Belgium | 401/79 |
| 1200785 | 2/1986 | Canada | 401/266 |
| 100204 | 2/1984 | European Pat. Off. | 401/266 |
| 250373 | 12/1987 | European Pat. Off. | 401/68 |
| 1336513 | 7/1963 | France | 132/320 |
| 2188980 | 1/1974 | France . | |
| 2577527 | 8/1986 | France | 132/320 |
| 493656 | 5/1954 | Italy | 132/318 |
| 1397499 | 6/1973 | United Kingdom . | |

*Primary Examiner*—Steven A. Bratlie

*Attorney, Agent, or Firm*—Antonelli, Terry, Stout & Kraus

[57] ABSTRACT

A package for a stick product, such as an antiperspirant stick, comprises a barrel for containing the stick, the barrel having an opening through which the stick can be exposed for use, and a product support member for supporting the end of the stick product opposite the end of the stick which is to be exposed. The support member is movable for adjusting the amount of the stick product which is exposed for use through the barrel opening. An applicator surface is provided about the periphery of the opening of the barrel for application and rubbing in of a visible amount of product. The package, including the applicator surface, allows the consumer to rub the product in while avoiding contacting the underarm with the relatively narrow edge of the barrel. The quantity of product being applied can also be accurately controlled using the package. The surface of the product support member has a configuration, in cross section, like that of the applicator surface adjacent the periphery of the opening, so that the product can be used to the bottom of the stick.

17 Claims, 4 Drawing Sheets

STICK PACKAGE WITH APPLICATOR SURFACE

This application is a continuation of application Ser. No. 07/153,439, filed on Feb. 8, 1988 now abandoned.

BACKGROUND OF THE INVENTION

The present invention is directed to a package for a stick type product (e.g., a solid stick product). More particularly, the invention is directed to an antiperspirant (we include within the term "antiperspirant" a deodorant, deodorant/antiperspirant or antiperspirant) stick package (e.g., for underarm use).

A conventional package for a solid stick type product, such as a conventional antiperspirant stick package, comprises a barrel for containing an antiperspirant stick. The barrel has an opening through which a first end of the stick can be exposed for use. A second, opposite end of the antiperspirant stick is supported on a movable product support member within the barrel. The support member can be moved as by pushing or with the use of a screw feed mechanism, for example, for adjusting the amount of the antiperspirant stick which extends beyond the barrel opening. The upper edge of the barrel about the opening is a relatively narrow edge which is not itself adapted to be used in applying the product.

To use the antiperspirant stick of this type of conventional package, the user adjusts the stick relative to the barrel until the end of the stick protrudes through the opening of the barrel a sufficient distance for rubbing the end of the stick against the underarm. This distance is typically one quarter inch to one half inch. The product is elevated with respect to the barrel to this extent so as to avoid contacting the underarm with the relatively narrow edge of the barrel. The elevated portion of the stick is subject to crumbling, cracking and breakage during use because of the stresses placed on the stick during application, all of the application forces being borne by the stick itself. This conventional antiperspirant stick package is also disadvantageous in that it does not allow the user to precisely control the amount of product which is being applied and, further, because the stick itself cannot be used to the very bottom of the stick without the possibility of contacting the underarm with, e.g., the movable product support member and/or the relatively narrow edge of the barrel.

An example of a package for a solid stick type product is shown in U.S. Pat. No. 4,605,330. The package disclosed in this patent includes a tubular container body with an open upper end and a lower end substantially closed by a base member. Included within the container body is a follower embedded in and adhered to the solid stick product, the follower being able to be fully retracted within the container body so that the entire inner volume of the container body may be filled with the solid stick product, thereby minimizing wastage of container space. This patent further discloses that the upper edges of the follower structure are curved such that the effective upper surface of the follower is dome-shaped, such curved upper surface being preferred for followers for, e.g., solid antiperspirant packages to maximize consumer comfort and minimize product waste.

However, this patent does not contemplate an applicator surface for applying the solid stick type product. Furthermore, this patent does not describe any correspondence between an applicator surface, as part of the package, and the bottom support for the stick-type product.

U.S. Pat. No. 2,917,765 discloses a dispensing container for materials such as creams, pastes and salves, using a screw-operated piston assembly to expel the material from the container through dispensing openings in a dispensing head onto the dispensing head, the dispensing head then acting as an applicator for applying the material. The material expelled is not a stick-type product; and the dispensing head of this patent, having a plurality of openings therein but not being entirely open over the container, is not usable with a stick-type product within the contemplation of the present invention.

Thus, the above-discussed documents do not overcome the disadvantages of prior packages for stick-type products, with respect to application of the product and minimizing product waste.

SUMMARY OF THE INVENTION

An object of the present-invention is to provide an improved package for a stick type product which avoids the aforementioned disadvantages with conventional packages. More specifically, an object of the invention is to provide an improved package for a stick type product, such as an antiperspirant product, which overcomes the deficiency of current stick packages related to crumbling, cracking and product breakage during use.

A further object of the present invention is to provide an improved package for a stick type product having a means for applying the stick with reduced drag (by reduced drag, we mean that the stick can glide more easily on the skin) while allowing the consumer to rub the product in without a relatively narrow barrel edge contacting his or her skin.

An additional object of the invention is to provide an improved package for a stick type product which enables the product to be used to the very bottom of the stick.

Another object of the invention is to provide an improved package for a stick type product which permits the consumer to deliver a visible adjustable dose of product to be applied and then to apply and rub in the predetermined visible amount of product using the package.

These and other objects are attained with the package for a stick type product of the invention which comprises means for supporting a stick type product such that an end of the stick type product can be exposed for use, and an applicator surface provided about at least a portion of the periphery of the stick type product, at the exposed end of the stick type product, to facilitate application of the product. Crumbling, cracking and product breakage during use are prevented with the package of the invention due primarily to the fact that the product need only be elevated a slight amount above the applicator surface as compared to the current stick packages which are elevated much further to avoid contacting the underarm with the relatively narrow edge of the barrel. The reason why breakage and crumbling are prevented or reduced is that the moment arm formed by the product is reduced.

According to a preferred form of the invention, the means for supporting the stick type product comprises a barrel for containing the stick type product. The barrel has an opening through which the end of the product can be exposed for use. The applicator surface extends outwardly from the opening of the barrel about at least a portion of the periphery of the opening, and preferably about the entire periphery. The applicator surface is formed integrally with the barrel in the disclosed, preferred embodiment of the invention but may be formed as a separate member and attached to the barrel. The applicator surface has an inner surface portion, closest to the opening in the barrel, and an outer surface portion extending toward an outer end of the applicator surface. The outer surface portion of the applicator surface is rounded for reducing drag during application of the stick type product. The applicator surface has a width sufficient to aid in applying and rubbing in the product. This width is preferably at least about 3/16 inch and more preferably about ¼ inch or more; and the outer surface portion is rounded with, e.g., a preferred radius of curvature of about 3/16 inch when the width of the applicator surface is ¼ inch.

The applicator surface of the present invention has an inside edge, closest to the opening at the top of the barrel, and an outside edge furthest from the opening at the top of the barrel. When the barrel is held vertically, with the opening at the top, the outside edge of the applicator surface is below the level of the inside edge (with respect to the top of the barrel), so as to provide a surface to reduce drag during application of the stick type product. For example, the applicator surface can be curved, in extending away from the opening at the top of the barrel, so as to have such outside edge below the level of the inside edge; alternatively, the applicator surface can have a flat portion extending from the inside edge thereof, with a further, curved portion extending from such flat portion, so as to provide the outside edge below the level of the inside edge.

The means for supporting the stick type product further comprises a movable product support member for supporting the end of the stick type product opposite the end which can be exposed from the package for use; while not limiting, push-up or propel/repel type packages, among others, can be used to provide support member (and thereby stick) movement. The support member is movable for adjusting the amount of the stick type product which is exposed for use. The support member has a support surface which contacts the-stick product. The support surface and at least the portion of the applicator surface adjacent the exposed end of the stick have like configurations as seen in cross section so that the product can be used to the very bottom of the stick. In one, preferred form of the invention the support surface and the applicator surface have the same outwardly convex configuration as seen in cross section which facilitates application and rubbing in of the product on the curved underarm. In another form of the invention, the support surface and the applicator surface adjacent the exposed end of the stick are both flat as seen in cross section. The applicator surface and the barrel are oval shaped in the preferred form of the invention but could be any other shape including round.

The package of the invention is designed to allow the user to deliver a visible adjustable dose of product above the level of the applicator surface which can then be rubbed in. This permits the user to accurately control the amount of product that is applied.

These and other objects, features and advantages of the present invention will become more apparent from the following description when taken in connection with the accompanying drawings, which show, for purposes of illustration, several embodiments in accordance with the present invention.

DETAILED DESCRIPTION OF THE DISCLOSED EMBODIMENTS

Figure 1:
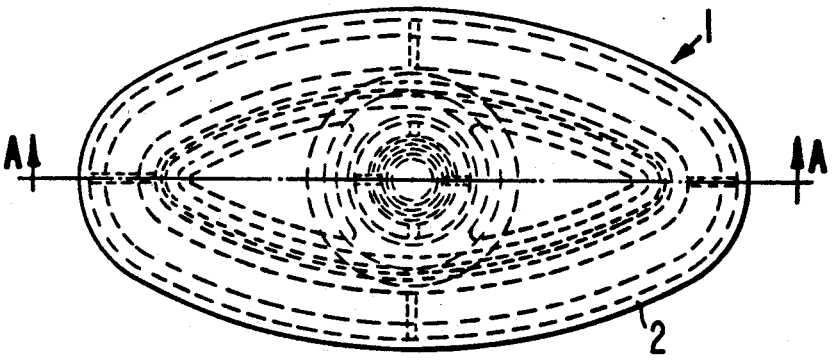
FIG. 1 is a top view of a preferred embodiment of the package of the invention for a stick type product, particularly an antiperspirant stick.

Referring now to the drawings, a package 1 according to a first embodiment of the invention and its component parts are illustrated in FIGS. 1–8. The package 1 is especially adapted for use with an antiperspirant stick, but could be used with other stick products such as lip balm, insect repellant, etc. The package 1 comprises a removable cap 2 for closing the package to protect the product therein. The cap is removed to permit application of the product by the user (e.g., where the product is an antiperspirant, the product can be applied to a person's underarms).

Figure 2:
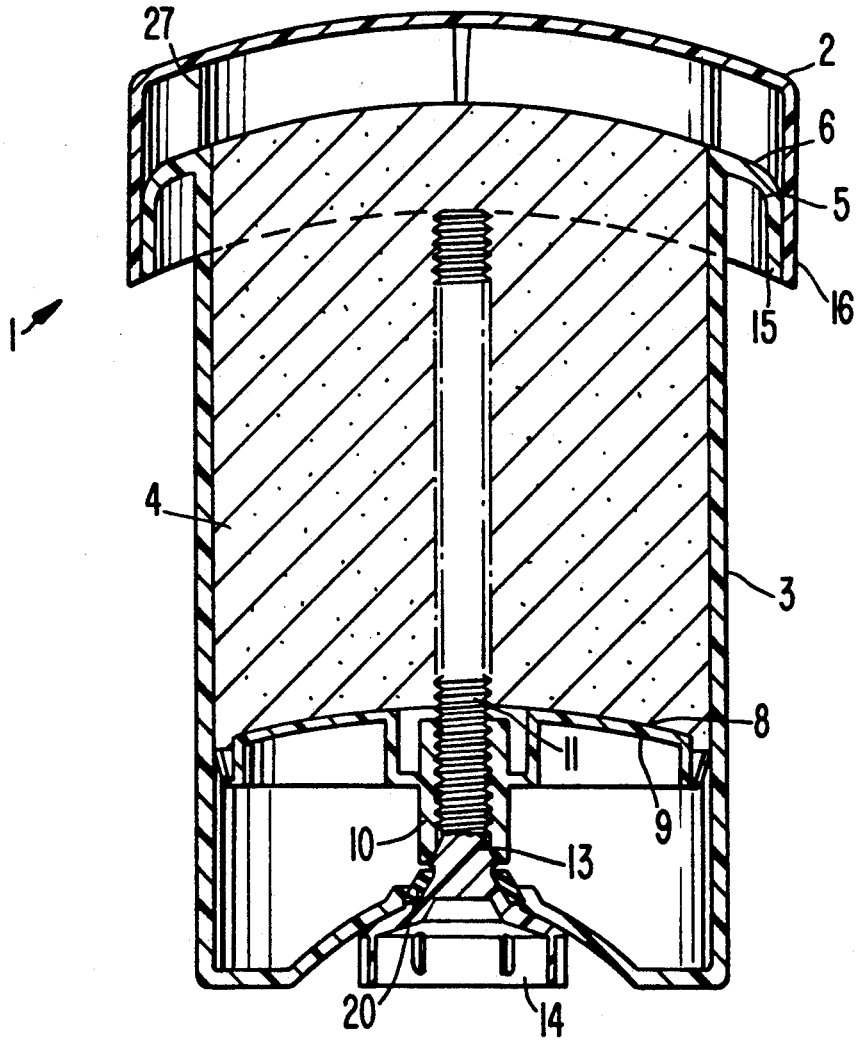
FIG. 2 is a cross-sectional view of the package taken along the line A—A of FIG. 1.
Figure 3:
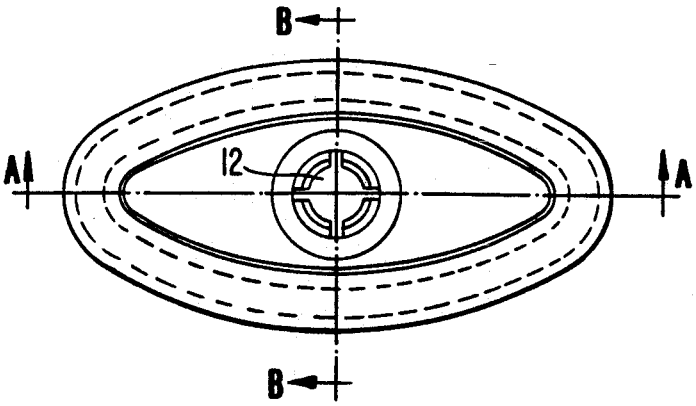
FIG. 3 is a top view of the barrel and integral applicator of the package.
Figure 4:
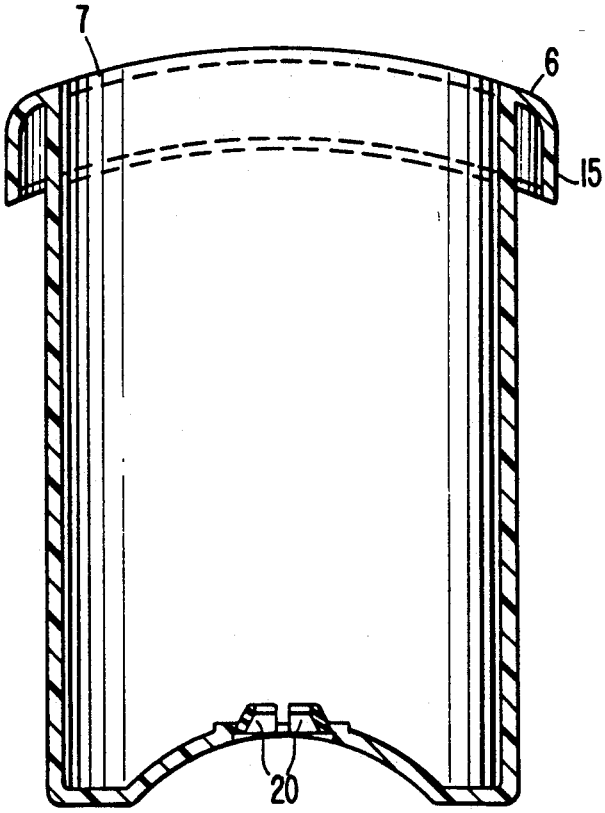
FIG. 4 is a cross-sectional view of the barrel and applicator taken along the line A—A in FIG. 3.
Figure 5:
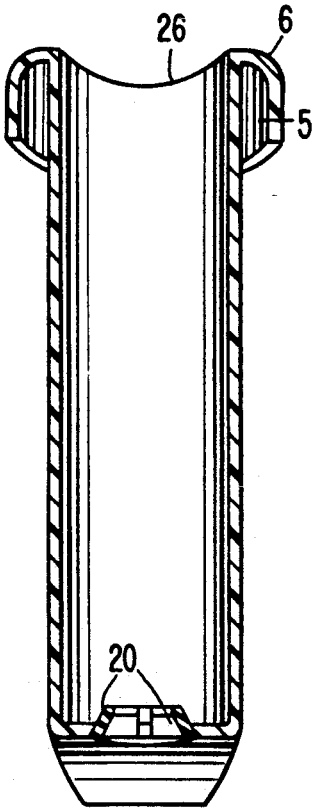
FIG. 5 is a cross-sectional view of the barrel and applicator taken along the line B—B of FIG. 3.

The package 1 further comprises a barrel 3 containing an antiperspirant stick 4. The wall of the barrel 3 closely surrounds the stick 4 as shown in FIG. 2. Both the stick and barrel are oval shaped in the embodiment of FIGS. 1–8 but other shapes could be used. An applicator 5 having an upwardly facing applicator surface 6 as shown in FIG. 2 is formed integrally with the barrel 3 at the top end thereof. FIG. 5 also shows applicator 5 having applicator surface 6, and also shows back edge 26 of the barrel. The applicator surface 6 extends outwardly from and completely around the periphery of an opening 7 (see FIG. 4) at the upper end of the barrel 3 through which the stick 4 is dispensed for use.

The lower end or bottom 8 of the stick 4 is supported within the package on an oval-shaped, movable support member 9 for movement up or down within the package relative to the barrel 3. A central portion of the-movable support member 9 is provided with a threaded coupling sleeve 10 for cooperation with an elevator screw 11. The lower end of the elevator screw is axially fixed but rotatable within an opening 12 in the closed, bottom end of the barrel 3. The elevator screw 11 includes a tapered section 13 which can be snap fitted within the opening 12 using resilient tabs 20, in the bottom of the barrel 3 to retain the elevator screw 11 in the position shown in FIG. 2 while permitting the screw to be rotated by means of a knob 14 provided on the lower end of the screw. The bottom of the barrel 3 is dished inwardly to accommodate the knob 14 so that the package 1 can stand upright with the lower, outer peripheral portion of the barrel 3 resting on a flat supporting surface. Rotation of the knob 14 permits the user to raise or lower the movable support member 9 relative to the barrel 3 and thus raise and lower the stick 4 relative to the barrel 3. The stick 4 is shown in its lowered position in FIG. 2 with the top of the stick flush with the applicator surface 6.

The several components of the package 1, including the cap 2, barrel 3, applicator 5 and coupling sleeve 10 are preferably each formed of plastic as by molding, although other materials can be used. For example, the cap, barrel and applicator can be made of polypropylene, with the movable support member made of high-density polyethylene. The elevator screw can be made of talc-filled polypropylene. The molding technique is known in the art. The applicator 5 is formed integrally with the barrel 3 in the embodiment of FIGS. 1–8 but can be formed as a separate component and attached to the barrel as by snap fitting, for example, as illustrated in the form of the invention shown in FIG. 9 of the drawings. The applicator surface 6 about the opening 7 is outwardly convex, as seen in cross section, in the direction of elongation of the oval shaped barrel. This contour lends itself to the smooth application of the antiperspirant stick 4 to the underarm. The applicator surface 6 of the applicator 5 extends outwardly from the stick 4 a sufficient distance to aid in applying and rubbing in the antiperspirant. In the illustrated embodiment, the applicator surface 6 extends approximately ¼ inch beyond the periphery of the stick 4 about the entire periphery of the stick. The outer surface portion of the applicator surface 6 is rounded (curved downward) for reducing drag during application of the antiperspirant. The outer surface portion ends in free end 15, which is below the applicator surface edge adjacent the barrel. The outer surface portion part that downwardly extends to free end 15 of the applicator is a cooperating surface upon which the lower skirt 16 of the cap 2 can be slidably fitted and removed with slight resistance. The cap 2 can have ribs 27 associated therewith to maintain the cap in a proper position relative to the barrel 3.

Various well-known techniques can be used to fill the barrel 3 with the stick-type product. For example, the known top-fill method (wherein molten product is poured into the open top of the barrel and the product allowed to solidify) can be used. Moreover, to form a product with a curved upper surface as shown in FIG. 2, the molten product can be poured into the open top of the barrel and allowed to solidify, with the product then being raised to protrude from the top of the barrel (or barrel/applicator), and the protruding portion then milled or shaved so as to provide the curved upper surface. Such milling or shaving to provide the curved upper surface are techniques known in the art.

To use the antiperspirant stick 4 within the package 1, the cap 2 is first removed and then the knob 14 is turned to advance the stick 4 to cause a slight amount, 1/16 inch, for example, of the stick to protrude above the applicator surface 6. The user can then apply the slight amount of the stick above the applicator surface to the skin by rubbing the protruding end of the stick 4 and the applicator surface 6 against the skin while grasping the package 1. The applicator surface 6 about the periphery of the stick 4 aids in applying and rubbing in the desired amount of antiperspirant. Once the protruding amount of the stick has been applied to the skin, the level of the stick will be essentially flush with the level of the surrounding applicator surface 6. With current stick packages, the stick is normally protruded ¼ inch to ½ inch above the barrel opening, the reason being to avoid contacting the underarm with the relatively narrow edge of the barrel. With the present invention a much smaller protrusion of the stick can be used, whereby the moment arm formed by the product is reduced to reduce or prevent crumbling, cracking and breakage of the product during use. In addition, the relatively wide, smooth applicator surface 6 which is rounded at its outer edge allows the user to comfortably rub the product into the skin without significant drag.

Figure 6:
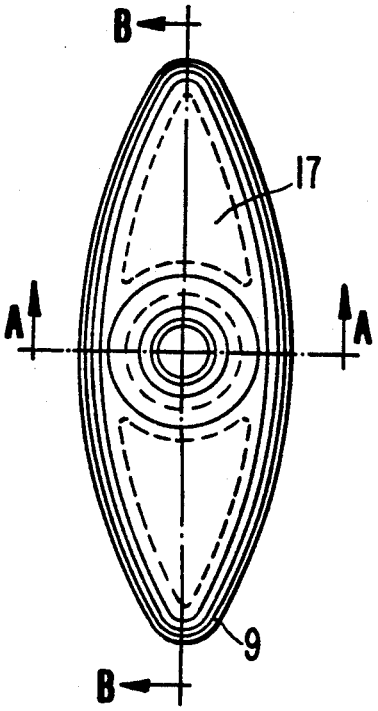
FIG. 6 is a top view of the movable support member for supporting the bottom of the antiperspirant stick in the package.
Figure 8:
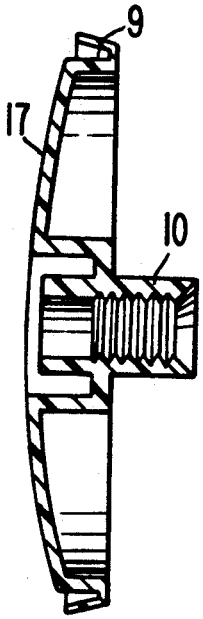
FIG. 8 is a cross-sectional view of the movable support member taken along the line B—B of FIG. 6.
Figure 7:
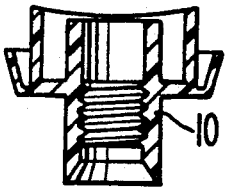
FIG. 7 is a cross-sectional view of the movable support member taken along the line A—A in FIG. 6.

As shown in FIGS. 6–8, the movable support member 9 has an upwardly facing support surface 17 for supporting the stick 4. The support surface and at least the portion of the applicator surface 6 about the opening 7 adjacent the exposed end of the stick have like configurations as seen in cross section. In particular, in the embodiment of FIGS. 1–8 both the support surface 17 of support member 9 and the applicator surface 6 have the same outwardly convex curvature in their direction of elongation as seen in cross section. This is particularly advantageous in that it permits the stick 4 to be used to the very bottom of the stick over substantially the entire cross section of the stick.

Figure 9:
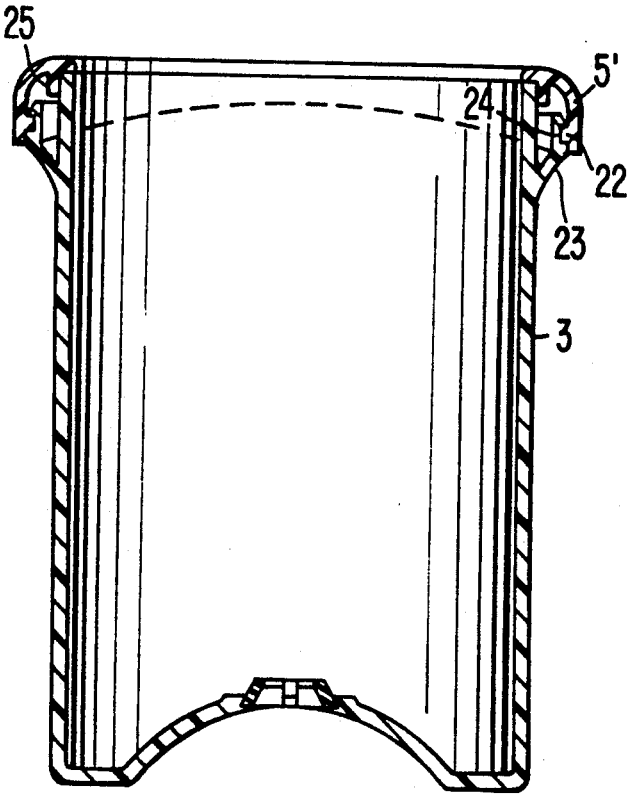
FIG. 9 is a cross-sectional view of another form of the barrel and applicator for the package of FIG. 1.

FIG. 9 shows another form of the barrel and applicator, where the applicator is formed as a separate member and attached to the barrel. Thus, in FIG. 9 applicator 5′ has a protruding portion 22 which snap-fits into indent 24 on extension 23 of barrel 3. The applicator further includes protrusion 25 which fits against the barrel 3. As can be appreciated, the applicator 5′ is fixedly held on the barrel by protruding portion 22 held in the indent 24. Other means for attaching the separately formed applicator to the barrel, such as adhesives or a friction fit of the applicator on the barrel, can be used within the scope of the present invention.

Figure 10:
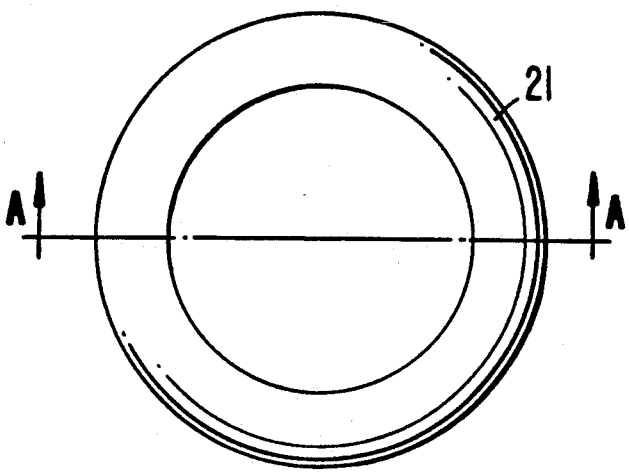
FIG. 10 is a top view of a package for a stick type product according to a second embodiment of the invention, the cap for the package not being shown.
Figure 11:
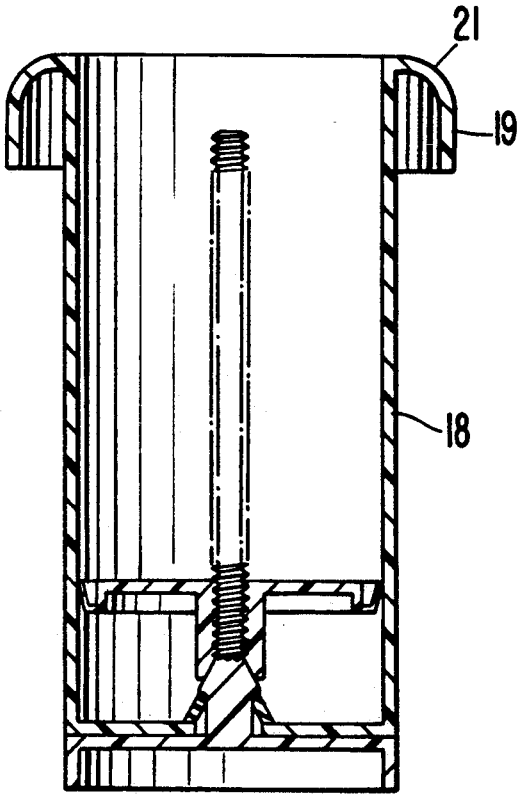
FIG. 11 is a cross-sectional view of the package of FIG. 10 taken along the line A—A.

In the embodiment of the-invention illustrated in FIGS. 10 and 11, the applicator 19 and barrel 18 are circular rather than oval shaped as in the embodiment of FIGS. 1–8. Further, the applicator surface 21 is flat as seen in cross section except that its outer edge is rounded downwardly. The barrel 18 and applicator 19 shown in FIGS. 10 and 11 are integrally formed. However, these components could be formed as separate pieces and joined together as by snap fitting, for example.

From the above description, taken with the accompanying drawings, it is readily seen that the package for a stick type product of the invention enables the user to protrude only a slight amount of the product above the applicator surface before use to reduce breakage and crumbling of the product during application and permit accurate control of the amount of the product being applied. The applicator surface of the package also reduces drag. In addition, the package permits the product to be used to the very bottom of the stick.

While we have shown and described only several embodiments in accordance with the present invention, it is understood that the same is not limited thereto, but is susceptible to numerous changes and modifications as known to those skilled in the art. Therefore, we do not wish to be limited to the details shown and described herein, but intend to cover all such changes and modifications as are encompassed by the scope of the appended claims.

What is claimed is:

1. A package antiperspirant solid stick product comprising means for supporting a solid stick product such that an end of the solid stick product can be exposed for use, the means for supporting a solid stick product including a stick surrounding member for surrounding the solid stick product, the stick surrounding member having an opening such that the solid stick product can be exposed for use, a border of the stick surrounding member forming the opening, said border forming a top end of the supporting means, the border of the stick surrounding member being outwardly convex as seen in cross section, whereby the top end of the supporting means is outwardly convex in cross-section, the stick surrounding member being oval shaped and the border thereof being outwardly convex in cross section in the elongated direction of the oval shape; and an antiperspirant solid stick product contained in the stick surrounding member.

2. The package antiperspirant solid stick product according to claim 1, wherein the stick surrounding member is a barrel, and said border is an edge of the barrel forming said opening such that the stick product can protrude and be exposed.

3. The package antiperspirant solid stick product according to claim 1, wherein the stick surrounding member extends in a direction from a bottom of the package to said opening, and surrounding a space to be occupied by the solid stick product, the space surrounded by the stick surrounding member, as projected on a plane perpendicular to said direction, being substantially the same as the size of the opening as projected on said plane.

4. A package antiperspirant solid stick product comprising means for supporting an antiperspirant solid stick product such that an end portion of the antiperspirant solid stick product can be elevated from said means for supporting and can protrude therefrom so as to be exposed for use; said means for supporting an antiperspirant solid stick product including a stick surrounding member, the stick surrounding member having an opening through which the end portion of the stick product can protrude for use, the stick surrounding member extending in a direction from a bottom of the supporting means to said opening, the stick surrounding member having an edge, at said opening, that is relatively narrow; an antiperspirant solid stick product contained within the stick surrounding member; means for elevating said antiperspirant solid stick product so that said end portion protrudes from the means for supporting so as to be exposed during use; and an applicator surface provided about the entire periphery of said means for supporting an antiperspirant solid stick product and having an opening coextensive with the opening of the stick surrounding member, to facilitate application of the antiperspirant solid stick product, said applicator surface being a continuously smooth surface, around the entire periphery of said means for supporting, for application of the antiperspirant solid stick product; said applicator surface being relatively wide as compared to the width of the relatively narrow edge of the stick surrounding member, whereby the antiperspirant solid stick product can be elevated a smaller distance out of the package while avoiding contact of the relatively narrow edge with a surface to which the antiperspirant solid stick product is applied, as compared to the distance that the antiperspirant solid stick product would be elevated without the applicator surface in order to avoid said contact, so that breaking and crumbling of the antiperspirant solid stick product, due to forces on the stick during use when said end portion protrudes, can be reduced; the applicator surface only extending outwardly from the means for supporting the stick product, the applicator surface being adapted to aid in applying and rubbing in a desired amount of the antiperspirant solid stick product.

5. A packaged antiperspirant solid stick product comprising means for supporting an antiperspirant solid stick product such that an end portion of the antiperspirant solid stick product can be elevated from said means for supporting and can protrude therefrom so as to be exposed for use; said means for supporting an antiperspirant solid stick product including a stick surrounding member, the stick surrounding member having an opening through which the end portion of the antiperspirant solid stick product can protrude for use, the stick surrounding member extending in a direction from a bottom of the supporting means to said opening, the stick surrounding member having an edge, at said opening, that is relatively narrow; means for elevating said antiperspirant solid stick product so that said end portion protrudes from the means for supporting so as to be exposed during use; an antiperspirant solid stick product contained within the stick surrounding member; and an applicator surface provided about the entire periphery of said means for supporting an antiperspirant solid stick product and having an opening coextensive with the opening of the stick surrounding member, to facilitate application of the antiperspirant solid stick product, said applicator surface being a continuously smooth surface, around the entire periphery of said means for supporting, for application of the antiperspirant solid stick product; said applicator surface being relatively wide as compared to the width of the relatively narrow edge of the stick surrounding member, whereby the solid stick product can be elevated a smaller distance out of the stick surrounding member while avoiding contact of the relatively narrow edge with a surface to which the antiperspirant solid stick product is applied, as compared to the distance that the solid stick product would be elevated without the applicator surface to avoid said contact, so that breaking and crumbling of the solid stick product, due to forces on the stick during use, when said end portion protrudes, can be reduced, the applicator surface only extending outwardly from the means for supporting the stick product, at least an outer surface portion of said applicator surface being rounded downwardly for reducing drag during application of the antiperspirant solid stick product, the applicator surface, being a continuously smooth surface and relatively wide, and having said outer surface portion, being adapted to aid in applying and rubbing in a desired amount of the antiperspirant solid stick product.

6. The packaged antiperspirant solid stick product according to claim 5, wherein said means for supporting said antiperspirant solid stick product comprises a barrel for containing said antiperspirant solid stick product, said barrel having said opening through which said end portion of the antiperspirant solid stick product can protrude and be exposed for use, said barrel having an inner surface within which the solid stick product is contained, and wherein said applicator surface extends outwardly from said barrel inner surface about the entire periphery of said inner surface of said barrel.

7. The packaged antiperspirant solid stick product according to claim 6, wherein said applicator surface is formed integrally with said barrel.

8. The packaged antiperspirant solid stick product according to claim 6, wherein the barrel has an edge forming the opening of the stick surrounding member, the barrel edge being the relatively narrow edge of the stick surrounding member.

9. The packaged antiperspirant solid stick product according to claim 5, wherein said means for supporting includes a product support member for supporting the end of the antiperspirant solid stick product opposite said end portion which can protrude and be exposed, said support member being movable for adjusting the amount of said antiperspirant solid stick product which protrudes and is exposed for use, said support member having a support surface for supporting said antiperspirant solid stick product, at least the applicator surface adjacent the opening and said support surface of the support member having like configuration as seen in cross section, whereby the product can be used substantially to the bottom of the antiperspirant solid stick product.

10. The packaged antiperspirant solid stick product according to claim 9, wherein said support surface and said applicator surface are both outwardly convex as seen in cross section.

11. The packaged antiperspirant solid stick product according to claim 9, wherein said support surface and the applicator surface adjacent said opening are both flat as seen in cross section.

12. The packaged antiperspirant solid stick product according to claim 5, wherein said applicator surface is oval shaped and outwardly convex in cross section in the elongated direction of said oval shape.

13. The packaged antiperspirant solid stick product according to claim 5, wherein the applicator surface includes (1) an inner surface portion, closest to the opening of the stick surrounding member and extending out from the opening of the stick surrounding member, and (2) said outer surface portion that is rounded downwardly, extending from the inner surface portion.

14. The packaged antiperspirant solid stick product according to claim 5, wherein the applicator surface includes inside and outside edges, respectively closest to and furthest from the opening of the stick surrounding member; and wherein, when the stick surrounding member is held vertically with the opening thereof at the top, the outside edge is below the level of the inside edge such that drag is reduced during application of the solid stick product.

15. The packaged antiperspirant solid stick product according to claim 5, wherein said means for elevating includes a screw feed mechanism having an elevator screw such that upon rotation of the elevator screw the product is pushed up from the bottom such that the end portion protrudes and is exposed for use.

16. The packaged antiperspirant solid stick product according to claim 5, wherein said applicator surface has a width of at least 3/16 inch so as to have a width sufficient to aid in applying and rubbing in the antiperspirant solid stick product.

17. The packaged antiperspirant solid stock product according to claim 5, wherein the means for elevating is a means for pushing up the antiperspirant solid stick product so that the end portion protrudes from the means for supporting and is exposed for use.

* * * * *